US005868431A

United States Patent [19]

Dudley

[11] Patent Number: 5,868,431

[45] Date of Patent: Feb. 9, 1999

[54] REPRINTABLE LABEL

[76] Inventor: Peter B. Dudley, 16359 Shady View La., Los Gatos, Calif. 95032

[21] Appl. No.: 763,540

[22] Filed: Dec. 10, 1996

[51] Int. Cl.[6] ..... B42D 15/00

[52] U.S. Cl. ..... 283/81; 283/111; 283/101

[58] Field of Search ..... 283/81, 79, 101, 283/117, 114, 95, 111; 434/410; 401/292

[56] References Cited

U.S. PATENT DOCUMENTS

| | | | |
|---|---|---|---|
| 2,894,336 | 7/1959 | Thorner | 434/410 |
| 3,943,643 | 3/1976 | Fisher et al. | 434/410 |
| 4,763,929 | 8/1988 | Weil | 434/410 |
| 5,024,332 | 6/1991 | Stachler | 434/410 X |
| 5,098,562 | 3/1992 | Smolinski | 434/410 X |

FOREIGN PATENT DOCUMENTS 92022434 12/1992 WIPO .

*Primary Examiner*—Willmon Fridie, Jr.

[57] ABSTRACT

A reprintable label that can be printed and erased many times without becoming visually degraded. The label is particularly suited for displaying the due date on library materials and video rentals. The label consist of a normally opaque plastic sheet attached to a wax coated colored card. On the back of the colored card is a pressure sensitive adhesive for attaching the label to articles. Printing is accomplished by the application pressure to the opaque plastic sheet, so that it sticks to the underlying wax. Where the opaque sheet sticks to the wax it changes color. The label is erased by pneumatically lifting the plastic sheet away from the wax coating.

9 Claims, 3 Drawing Sheets

REPRINTABLE LABEL

FIELD OF THE INVENTION

This invention relates to labels, specifically to labels that can be printed upon and erased numerous times.

BACKGROUND TO THE INVENTION

A label that could be printed and erased fifty times or more, would be very useful for certain applications. One obvious application is the return due date associated with library materials. Libraries currently use several methods to indicate the date when a borrowed item is due to be returned. Some libraries print the due date on a slip of paper, which is handed to the patron. If the patron checks out more than one item, they will all be listed on the one paper. There are three disadvantages to this system. First, it consumes paper. Second, the due date information is separate from the borrowed item. The patron is unable to simply look on the book they are currently using, to determine its due date. Third, the small piece of paper is easily lost. Another method that has been used for years is to stamp or write the due date on a card. This card is then placed in a envelope attached to the book. This is a very time consuming method. The envelope is usually inside of the book. So, the book must be opened and then the card is removed. The date is then written or stamped onto the card. The card is then replaced into the envelope and the book closed. All of this handling is time consuming and costly for the libraries. The cards and envelopes are costly to purchase and further costs are incurred in replacing the cards when they are full or lost. Plus, there is the additional cost of mounting the envelopes in the books.

A third method uses a small label with the due date printed on it. These are applied directly to the book cover. A label applicator is used that both prints and applies each label. These applicators are hand operated. The librarians must squeeze the handle of the device for every item that they check out. This has resulted in some library workers now having repetitive motion injuries. Another disadvantage is the pile of labels that accumulate on popular books. Sometimes it becomes unclear, on which of these labels is the real due date? Periodically the mess of labels on the cover must be scrapped off. In an attempt to solve the confusion and mess, a new product has been developed. This is a special label that is applied to the cover. Printed on this label are boxes for placing the smaller due date labels. This allows the smaller labels to be applied in order and eliminates the confusion. After the special label is full it can be peeled off and replaced. This product solves the confusion problem, but at a cost. First, there is the cost of the these additional labels, applying them, and removing them. Then, there is the hidden cost of the added time required to apply each due date label accurately on the special label.

A new method, that only requires a single label to provide due date information, is disclosed in U.S. Pat. No. 5,290,066 Mody (1994). Mody's label is reprintable. The label is made from a special plastic sheet which is called Particle Oriented Paper (POP). Particles within the plastic sheet can be oriented by the application of magnetic fields. Depending on the resulting orientation of the particles, portions of the sheet will appear darker or lighter. Properly applied the magnetic fields can be used to print information onto POP. Magnetic fields are also used to erase the information from the POP. POP is commercially available from Eurand America, Inc. On testing a sample of POP provided by Eurand America, it was found that a magnetic field did darken it. But I found there was not much difference in contrast between the darkened (printed) and undarkened (unprinted) areas on the standard color POP provided by Eurand. This is because the standard color of POP is already a dark color, medium dark green. Used as a due date label, the date would be readable, but it certainly would not stand out. A second disadvantage of POP, is its present high cost. In quantities of five hundred square feet, it is priced by Eurand America at $9.50 per square foot.

The required use of magnetic fields for printing and erasing may be a disadvantage for using POP labels in another application. Mody (U.S. Pat. No. 5,290,066) describes using POP reusable labels in the video tape rental market. Some video stores allow different rental periods for different video titles. Returning the video just one day late will double the customers cost of the rental. The customer would obviously appreciate having the due date printed on these videos. Mody suggests using POP labels for this application. But he does not address the possible problem that might occur when erasing and printing POP labels. As previously stated, magnetic fields are used to erase and print POP labels. Magnetic fields are also used to erase and record on video tapes. The unanswered question is: could the erasing and printing of the POP label, erase or degrade the video recordings? If the answer is yes, then; the videos would need to be kept way from the magnetic fields of the POP label printers. A video tape would first have to be removed from its box before the POP label on the box could be erased and printed. Then the video could be replaced in the box. If these extra check out steps were necessary, that would be another disadvantage for POP labels. Mody provides no information on this potential problem of using POP labels in the video tape market.

In the preceding description of the limitations of the prior art, only library book and video tape rental applications have been discussed. They are only an example of the types of materials and situations requiring the temporary display of information. The scope of this patent should not be construed to be limited to library books and video tapes. For instance, further uses for labels that provide erasable and reprintable displays of information clearly exist in manufacturing and retailing. Products being manufactured are sometimes moved through the process in tubs, on carts or on pallets et cetera. It can be useful to have temporary information like part numbers, quantities, or work order information on the material handling device. A reusable label attached to the material handling device would provide a convenient place to display this information. Another useful area for reusable labels is in inventories. Manufacturer's, wholesaler's, and retailer's inventories are constantly changing. Reusable labels attached to shelves and bins could provide an inexpensive and convenient place to display the quantities of items in inventory. A further application could be in the display of prices of retail products. Product prices are also continually changing, especially in the grocery market. An attractive label with printed product description and a separate reprintable area for price information may offer cost savings in this application.

OBJECTIVES AND ADVANTAGES

It is an object of the present invention to provide an inexpensive label for the displaying of temporary information on a item. Several additional objectives and advantages of the present invention are:

(a) to provide a reusable label that can be machine printed and machine erased;

(b) to provide a reusable label that can be manually printed and erased;

(c) to provide a reusable label that can be reprinted 50 or more times;

(d) to provide a reusable label that is simple to print upon;

(e) to provide a reusable label that is simple to erase;

(f) to provide a means for providing due date information while reducing library labor costs;

(g) to provide a means for providing due date information while reducing library material costs;

(h) to reduce paper consumption;

(i) to provide a label that can be erased and printed without the application of a magnetic field;

(j) to provide a label that could provide temporary information in manufacturing applications;

(k) to provide a label that could provide temporary information in inventory applications;

(l) to provide a label that could provide temporary price information in retail applications.

These and other objects and advantages of the present invention, will no doubt become obvious to those of ordinary skill in the art, after having read the following detailed description of the embodiments, which are illustrated in the various drawing figures.

REFERENCE NUMERALS IN DRAWINGS

| | | | |
|---|---|---|---|
| 20 | reprintable label | 22 | date printed on label |
| 24 | colored card stock | 26 | pressure sensitive adhesive |
| 28 | adhesive | 29 | enclosed area |
| 30 | opaque plastic sheet | 32 | wax coating |
| 34 | wax free area | 36 | airhole |
| 38 | reprintable label with guard | 40 | adhesive |
| 42 | face guard | 44 | openings |
| 46 | air hole | 48 | reprintable label with pull tab |
| 50 | pull tah | 52 | pull tab base |
| 54 | truncated triangular member | 56a | angled surface |
| 56b | angled surface | 58 | adhesive |
| 60 | adhesive free area | 62 | fourth embodiment of reprintable label |
| 64 | sealing opaque plastic sheet | 66 | pressure sensitive adhesive |
| 68 | opaque sheet extension | | |

DETAILED DESCRIPTION

Figure 1:
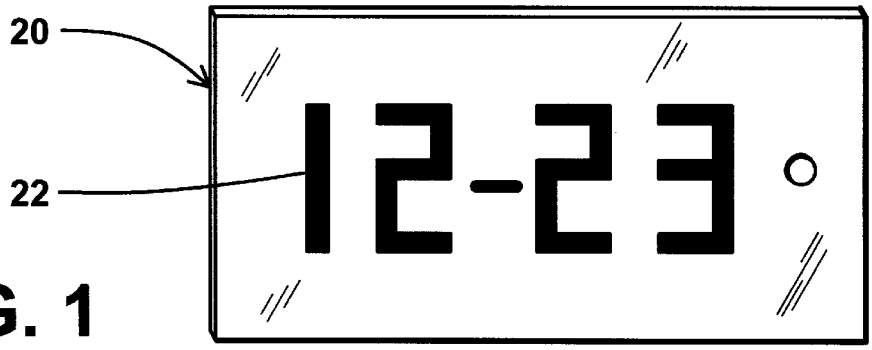
FIG. 1 is a perspective view of the preferred embodiment of the reprintable label.
Figure 2:
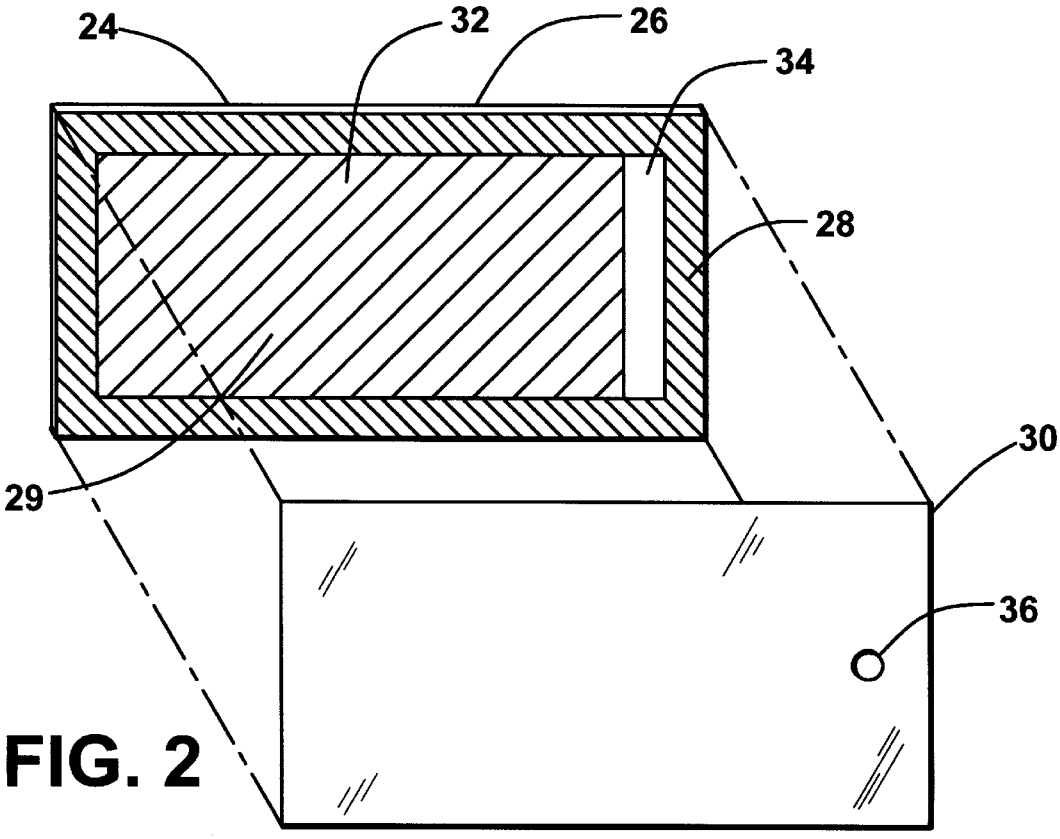
FIG. 2 is a exploded perspective view of the preferred embodiment illustrated in FIG. 1.

With reference to FIGS. 1 and 2, the preferred embodiment of an erasable and reprintable self-adhesive label, is indicated by the general reference character 20. FIG. 1 illustrates the label with a date printed on it 22. The base of the label is a flat body of material, such as a dark colored card stock 24. The back of the card 24 is coated with pressure sensitive adhesive 26. An adhesive 28 attaches an opaque plastic sheet 30 to the front of the card 24. This creates an enclosed area 29 between the card stock 24 and the opaque plastic sheet 30. The opaque plastic sheet 30 could be made from polyethylene. To make it opaque, the polyethylene could be printed with a white or light colored ink. The color printed side of the polyethylene sheet 30 faces the card 24. The plastic sheet 30 has a small hole 36 for air passage. A thin layer of wax coats the card in the area 32. A small area 34, near the air hole 36, is left uncoated.

Figure 3:
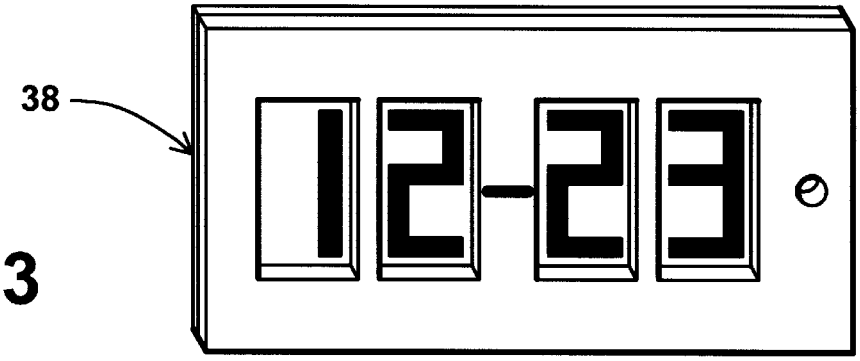
FIG. 3 is a perspective view of a second embodiment which incorporates a face guard.
Figure 4:
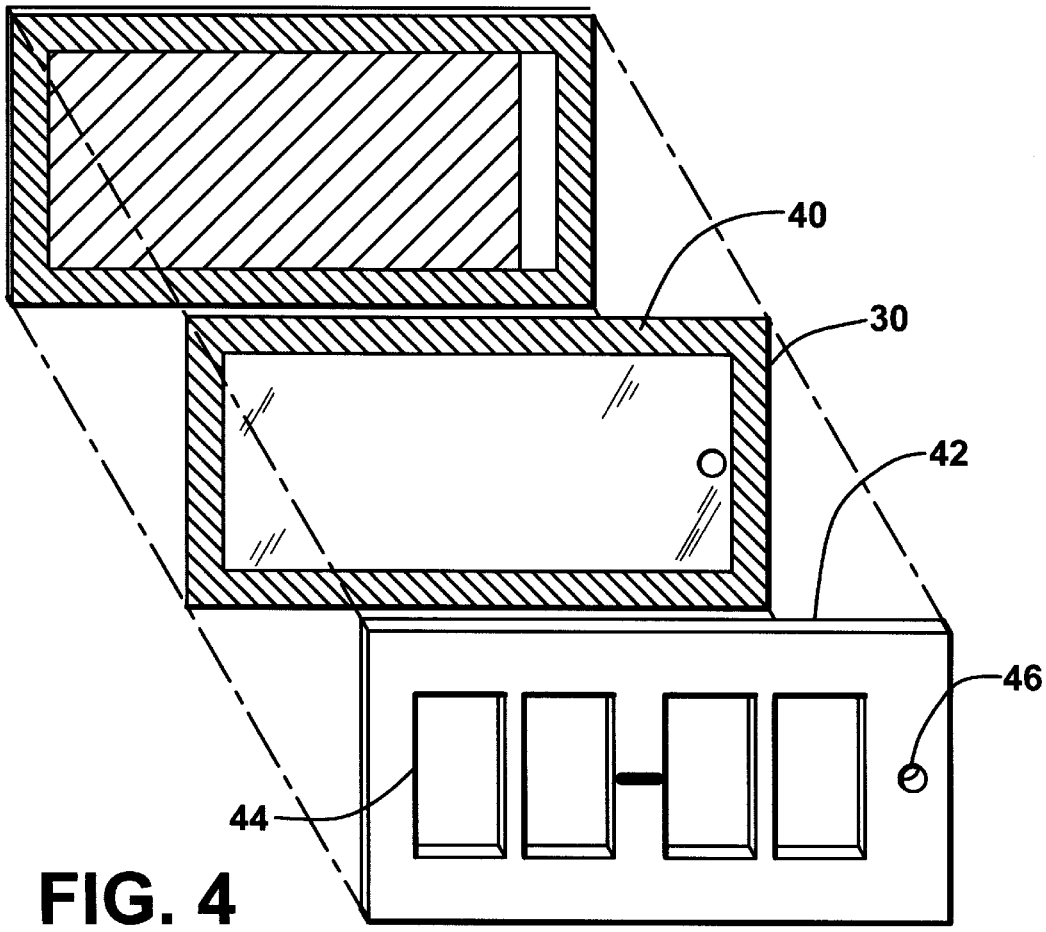
FIG. 4 is a exploded perspective view of the second embodiment illustrated in FIG. 3.

FIGS. 3 and 4 illustrate a second embodiment of the reprintable label. This label 38 incorporates a face guard 42, to protect printed data. Guard 42 could be made from cardboard or plastic. Adhesive 40 is used to bond the guard to the outside edges of plastic sheet 30. Openings 44 allow data to be printed and erased on the label. A small hole 46 is aligned with air hole 36 and allows for air passage.

Figure 5:
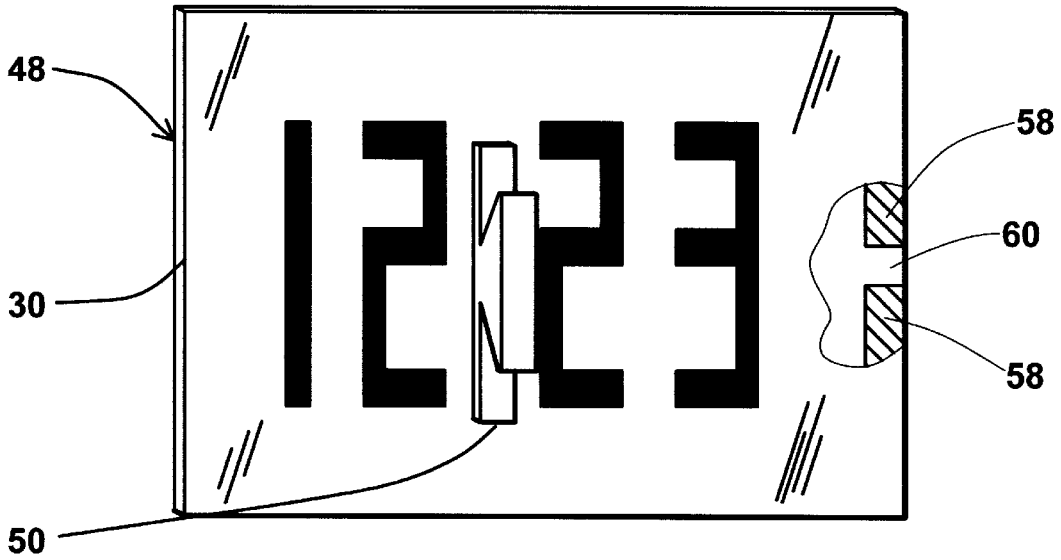
FIG. 5 is a perspective view of the third embodiment which incorporates a pull tab for erasing.
Figure 6:
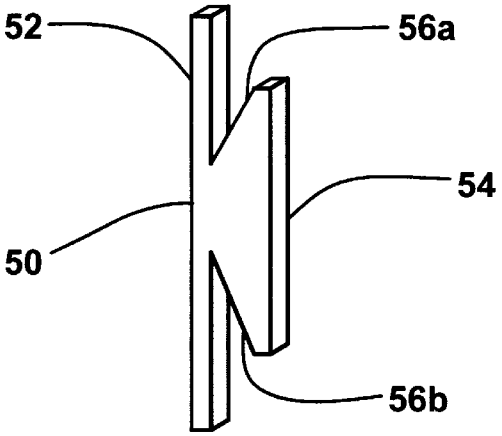
FIG. 6 is an enlarged perspective view of the pull tab.
Figure 7:
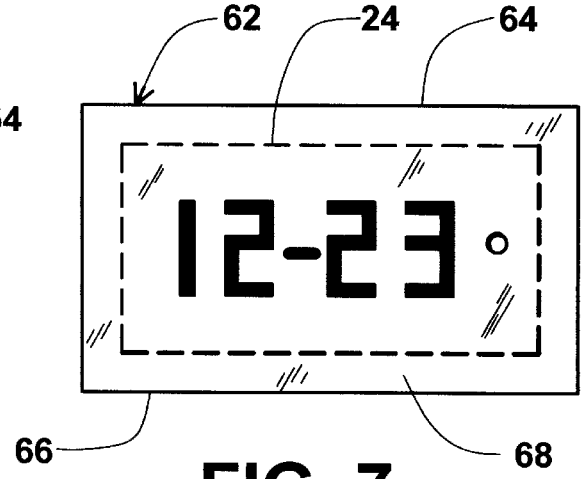
FIG. 7 is a perspective view of the fourth embodiment of the reprintable label which incorporates an enlarged opaque sheet.

FIG. 5 illustrates the third embodiment of the label. This label 48 incorporates a pull tab 50 for erasing the data. The tab 50 is bonded at its base 52 to the opaque plastic sheet 30, near its center. FIG. 6 shows the details of the pull tab 50. The tab consists of a rectangular base 52 joined to a truncated triangular shape 54. The angular surfaces **56*a* and 56*b* are utilized during the erasing process. FIG. 5 also illustrates an alternate method of providing an air passage on the labels. There is a gap 60 in the adhesive 58 which attaches the opaque sheet to the card stock. Air is able to pass through this gap 60. The fourth embodiment is illustrated in FIG. 7. On this embodiment of the label, the opaque plastic sheet 64 has been made larger than the card stock 24 to which it is attached. On this extension 68 of the plastic sheet is a coating of pressure sensitive adhesive 66. The adhesive is on the side of the sheet which faces the card 24**.

OPERATION

As children many of us were familiar with the MAGIC SLATE® drawing toy, made by Western Publishing Company. Using a blunt instrument, pictures and words could be easily drawn on it. They could then be erased by manually lifting the opaque plastic sheet away from the dark surface it covered. Similarly, writing or printing on the reprintable label consists of applying downward pressure upon the opaque plastic sheet 30. With sufficient pressure the plastic sheet will stick to the underlying wax 32. Where it sticks, the reflected light is much darker, than from the surrounding non-sticking areas. The high contrast provides for an easily readable means of recording information, such as the due date 22 for a library book. Under normal conditions the recorded message will last indefinitely, until purposely erased. Erasing is accomplished, on all four embodiments, by moving the plastic sheet 30 away from the wax coated surface 32. When it moves away, the sheet will become unstuck from the wax and will return to a lighter color. The whole sheet is then a even light shade.

Two methods of moving the plastic sheet away from the wax can be used with the first, second, and fourth embodiments. The first method is to apply a partial vacuum to the front of the sheet, above the wax coating 32. The air hole 36 remains outside of the vacuum area and at normal air pressure. This allows the higher pressure air to flow through the air hole, and move the plastic sheet toward the partial vacuum. The alternative method is to keep the area above the sheet at normal air pressure and to blow compressed air into the air hole 36. This produces the same effect of lifting the sheet and erasing the label.

Erasing the third label embodiment utilizes a mechanical pulling method. As previously described, a pull tab 50 is bonded to the plastic sheet 30. Applying force to surfaces 56*a* and 56*b*, lifts pull tab 50 and sheet 30, away from the wax coated surface. As with the other embodiments, this label is erased when the sheet 30 is lifted away from the wax coating. The gap 60 in the adhesive layer 58, allows air to flow under the plastic sheet when it is lifted by the tab.

Because of the pull tab, the third embodiment of this pressure sensitive label would most likely only come mounted on sheets of backing paper. While all of the other embodiments could be easily mounted on both sheets or rolls of backing paper. All embodiments can be easily removed from the backing paper, and applied to a surface, such as the back cover of a book. The fourth embodiment has a larger opaque plastic sheet for improved sealing of the label onto book covers. When books are being shelved the label, because of its thickness, may be caught by an adjacent book. The larger sheet on this embodiment covers over the part of the label that could get caught. The exposed edge of this larger sheet is much thinner and very unlikely to be caught when books are being shelved.

SUMMARY, RAMIFICATIONS, AND SCOPE

Accordingly, the reader will see that the reprintable label of this invention can be used to provide due date information on library materials and video rental tapes. Besides these two applications, these reprintable labels could be used in many other fields. These labels on drawers, bins, and shelves could display quantities of parts or products stocked in inventories. These labels could also provide a convenient method of displaying the frequently changing retail prices in stores. In some manufacturing operations they could be used to display quantities and other useful information associated with parts being fabricated or products being assembled.

Although the description above contains many specificities, these should not be construed as limiting the scope of the invention, but as merely providing illustrations of some of the presently preferred embodiments of this invention. For instance, an alternative material for the colored card stock 24 could be colored plastic. Sonic bonding could be used for assembly, instead of the adhesives 28 and 40. The wax coating 32 can be replaced by other temporary type adhesives. Thus the scope of the invention should be determined by the appended claims and their legal equivalents, rather that by the examples given.

I claim:

1. A reprintable label comprising:

(a) a flat body of material;

(b) an opaque sheet whose periphery is adhered to said body;

(c) the adherence of said sheet to said body forming an enclosure;

(d) within said enclosure, a temporary adhesive means, sandwich between said body and said opaque sheet, whereby the recording of visually readable information may be accomplished by applying pressure against said opaque sheet, causing it to stick to said temporary adhesive means and altering the color of said opaque sheet in the area in which it sticks to said adhesive;

(e) an orifice in said enclosure.

2. The reprintable label of claim 1 further including an area free of said temporary adhesive adjacent said orifice.

3. The reprintable label of claim 1 further including a protective cover adjacent said opaque sheet.

4. The reprintable label of claim 1 further including a pressure sensitive adhesive on the surface of said flat body of material, on the side opposite the side attached to said opaque sheet.

5. A reprintable label comprising:

(a) an opaque sheet;

(b) a flat body of material, whose periphery is adhered to said opaque sheet;

(c) the adherence of said body to said sheet forming an enclosure;

(d) within said enclosure, a temporary adhesive means, sandwich between said body and said opaque sheet, whereby the recording of visually readable information may be accomplished by applying pressure against said opaque sheet, causing it to stick to said temporary adhesive means and altering the color of said opaque sheet in the area in which it sticks to said adhesive;

(e) an orifice in said enclosure;

(f) the periphery of said opaque sheet extending beyond the periphery of said body.

6. The reprintable label of claim 5 further including a coating of pressure sensitive adhesive on said extension of said opaque sheet on the side facing said body.

7. The reprintable label of claim 5 further including an area free of said temporary adhesive adjacent said orifice.

8. The reprintable label of claim 5 further including a protective cover adjacent said opaque sheet.

9. The reprintable label of claim 5 further including a pressure sensitive adhesive on the surface of said flat body of material, on the side opposite the side attached to said opaque sheet.

* * * * *